US006389722B1

(12) United States Patent
Josefsson et al.

(10) Patent No.: US 6,389,722 B1
(45) Date of Patent: May 21, 2002

(54) LABLE HOLDER

(75) Inventors: Börje Josefsson, Sundsvall; Richard Moser, Stockholm, both of (SE)

(73) Assignee: HL Display AB, Skarpnack (SE)

( * ) Notice: Subject to any disclaimer, the term of this patent is extended or adjusted under 35 U.S.C. 154(b) by 0 days.

(21) Appl. No.: 09/830,877

(22) PCT Filed: Nov. 1, 1999

(86) PCT No.: PCT/SE99/01963

§ 371 Date: May 2, 2001

§ 102(e) Date: May 2, 2001

(87) PCT Pub. No.: WO00/28512

PCT Pub. Date: May 18, 2000

(30) Foreign Application Priority Data

Nov. 6, 1998 (SE) ..... 9803810

(51) Int. Cl.[7] ..... G09F 3/00

(52) U.S. Cl. ..... 40/642.01; 40/658; 211/57.1; 211/59.1

(58) Field of Search ..... 40/642.01, 642.02, 40/666, 661.07, 661.08; 211/57.1, 59.1; 248/214, 231.81

(56) References Cited

U.S. PATENT DOCUMENTS

| | | | |
|---|---|---|---|
| 4,718,626 | A | 1/1988 | Thalenfeld et al. |
| 5,442,872 | A | 8/1995 | Moser |
| 5,826,359 | A | 10/1998 | Thalenfeld et al. |
| 5,860,239 | A | 1/1999 | Thalenfeld et al. |
| 5,941,003 | A | 8/1999 | Thalenfeld |

*Primary Examiner*—Cassandra H. Davis
(74) *Attorney, Agent, or Firm*—Sughrue Mion, PLLC

(57) ABSTRACT

A label holder which is intended to be mounted in front of the outer end of a rod (3) that projects out from a product display stand or corresponding structure. The rod includes a member (7) which enables the holder (4) to be pivotally mounted to the rod so that the holder can swing vertically. The rear side of the holder (4) includes a number of support surfaces (14, 15). The surfaces are located at mutually different distances from the rear surface of the holder and can be caused to coact selectively with the end surface of the rod (3) or with a rod-mounted member to enable the holder (4) to be adjusted to different angles relative to the rod.

10 Claims, 2 Drawing Sheets

Fig. 2
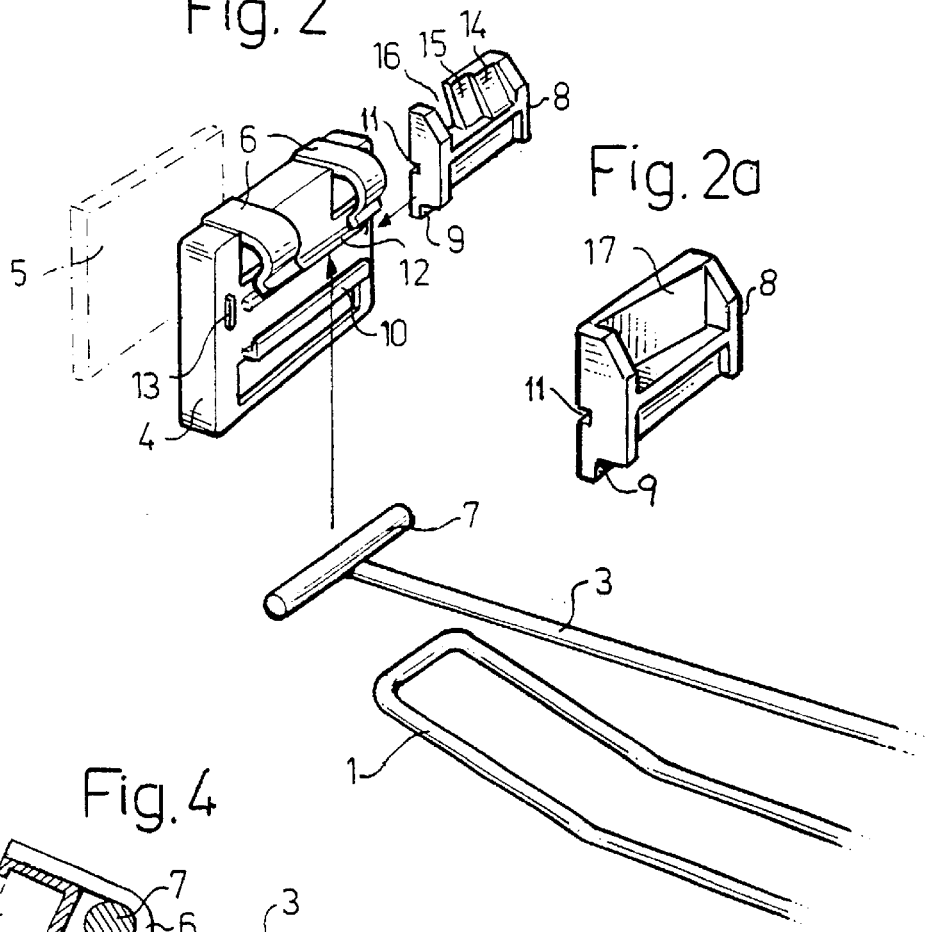
Fig. 2a
Fig. 4
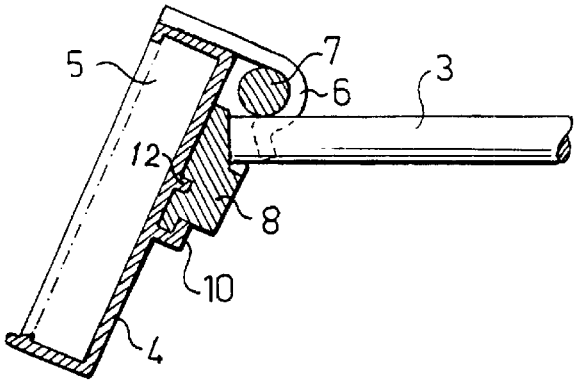
Fig. 5
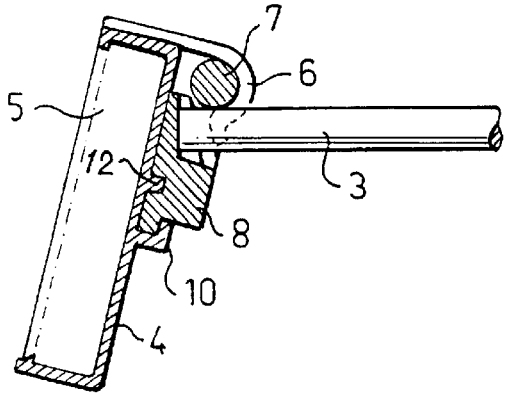

LABLE HOLDER

BACKGROUND AND SUMMARY OF THE INVENTION

The present invention relates to a label holder which is adapted to be mounted in front of the outer end of a rod which projects out from a product display stand and which is provided with means for enabling the holder to be pivotally mounted on the rod so as to enable the holder to be swung vertically.

The label or ticket holder is primarily intended for use in shops, stores and like establishments to display the price of and/or other information relating to products displayed on the carrier, for instance packages threaded along a generally horizontal prong.

When using a rod-mounted. label holder, the price label or the like can be caused to hang pivotally in front of the products displayed on the prong. Because the label holder can be swung vertically, it does not create an obstacle to the removal of products from the prong or to replenishing the prong with new products.

An earlier embodiment of a rod-mounted label holder for use together with a prong-carrying stand is described in our U.S. Pat. No. 5,442,872.

This known holder is able to take only one position and it is possible for the holder to be released involuntarily should it be subjected to an upwardly directed force in the plane of the label-receiving pocket.

Since a prong-carrying stand can include product display prongs that are located on mutually different levels, the products can make it difficult to read labels located at lower levels, when these labels are displayed with the aid of a vertically orientated holder. This problem is particularly evident in the case of so-called electronic labels, where prices and other information are displayed on an electronic display. Such a display is difficult to read unless it can be adjusted to a certain angular position in relation to the line of sight.

An object of the present invention is to provide for use with a prong-carrying stand a label holder, or ticket holder, that can be readily adjusted to several angular positions in relation to the rod on which it is carried.

Another object of the invention is to provide a label holder that can be readily mounted on a forwardly projecting rod in front of a display prong and which cannot be removed unintentionally from the rod once it is fitted thereto.

The first of these objects is achieved with a label holder of the kind described in the first paragraph that includes on its rear side a number of support surfaces which are spaced mutually at different distances from the rear surface of said holder and which can be caused to coact selectively with the end surface of the rod or with means fitted to the rod for enabling the holder to be set to different angles relative to the rod.

A label holder of this nature can be set easily to different angular positions, by relative displacement between the support surfaces and the rod.

In order to enable continuous, smooth adjustments to be made to the angle of the holder, the support surfaces may be formed by a continuous support surface that slopes in a wedge-like manner in the longitudinal direction of the holder, wherewith the angle of the holder is adjusted by causing the rod to coact with different parts of the sloping surface.

In order to be able to cause the rod to coact with a desired support surface while holding the label holder centered in front of a product display prong, it is preferred that the support surfaces are provided on a displaceable slide that can be moved along the rear surface of the label holder.

In one preferred embodiment, the label holder is provided with means which, when the holder is fitted to the rod, grip over a pin that extends transversely to the rod, said slide being adapted to prevent unintentional or involuntary removal of the holder from the pin. This can be achieved with the aid of generally U-shaped mounting devices which are formed so as to define between themselves and the rear surface of the holder an opening through which the pin can be passed and which is blocked at least partially by the sleeve when fitted. This prevents the holder from being dismantled from the pin without first having removed the slide.

Remaining features of the invention will be apparent from the following claims.

BRIEF DESCRIPTION OF THE DRAWINGS

The invention will now be described in more detail with reference to exemplifying embodiments thereof and also with reference to the accompanying drawings.

FIG. 2 illustrates the components of an inventive arrangement.

FIG. 2*a* illustrates an alternative embodiment of one of these components.

FIGS. 4–7 show the holder in different angular positions.

DETAIL DESCRIPTION OF THE INVENTION

Figure 1:
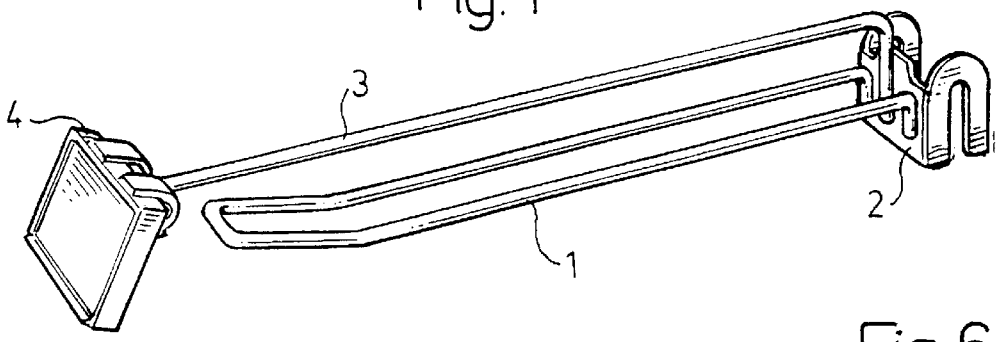
FIG. 1 illustrates an inventive holder mounted in front of a two-arm product display prong.

FIG. 1 illustrates a product display prong onto which packaged products can be threaded. The prong is supported by a mounting device 2 which is intended to be fitted to a display rack or the like.

Attached to the mounting device 2 is a rod 3 which projects out generally parallel with the prong 1. A holder 4 is pivotally mounted on the front end of the rod 3 in accordance with the invention. The holder can support any desired type of label or ticket that discloses the price of or other information relating to the products hanging from the prong 1. The holder is particularly intended to support a so-called electronic label, i.e. an electronic display 5 with which the information displayed can be easily altered. However, in order to enable the display to be read optimally, it is necessary to be able to angle the display so that it defines essentially a right angle with the line of sight.

As will be seen from FIG. 2, the holder 4 includes two rearwardly extending hook-like elements 6 which can be snapped firmly over a pin 7 fitted transversely on the rod 3. This enables the holder to be swung vertically around the pin.

Subsequent to having mounted the pin 7 on the holder 4, a displaceable slide 8 is fitted to the rear surface of the holder. A bottom part 9 of the slide is guided in a groove or channel 10 on the holder. The slide 8 also includes a slot 11 into which a guide strip 12 on the holder can be fitted. The upper part of the slide 8 is located behind the hook-like elements 6.

The slide 8 will thus block the opening between the hook-like elements 6 and the rear surface of the holder 4 as shown in FIG. 4 for instance, therewith preventing the holder from being removed from the pin 7 unintentionally, provided that the slide 8 is in place. Reference numeral 13 identifies stop means for preventing sideways movement of the slide 8.

Figure 3:
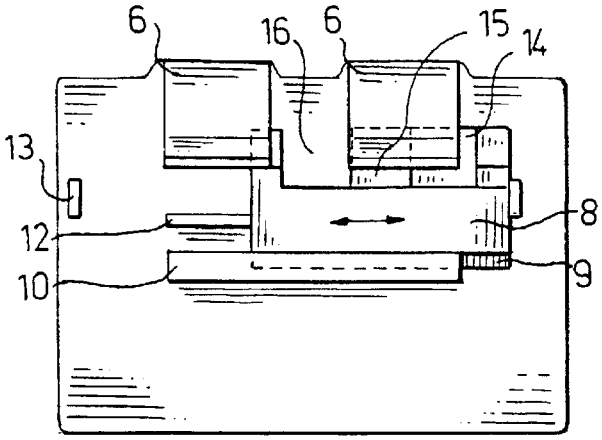
FIG. 3 is a rear view of the holder.

FIG. 3 illustrates how the slide 8 is able to move sideways when fitted to the rear surface of the holder. The rod 3 and the pin 7 have been omitted from FIG. 3 for the sake of clarity.

The slide 8 has two support surfaces 14, 15 and a through-passing recess 16. This enables the holder 4 to be set to three different angles in relation to the rod 3. This is achieved by virtue of the fact that the surfaces 14 and 15, which can be utilized as support surfaces for the front end of the rod 3, lie at mutually different distances from the rear surface of the holder. When the rod 3 is located centrally opposite the recess 16, the rear surface of the holder 4 will itself provide a support surface for the front end of the rod instead. The various support surfaces can be caused to coact selectively with the rod 3, by displacing the slide 8 sideways in relation to the holder 4.

In this regard, FIG. 4 shows the position in which the rod 3 coacts with the support surface 14 that lies distal from the rear surface of the holder 4. This gives the holder the largest angle relative to the rod 3 and is used when the prong 1 is situated at a low height. The surface 14 will suitable slope vertically so as to provide effective abutment with the front end of the rod 3. It will also be seen from the Figure that the pin 7 is locked in the hook-like elements 6 by the slide 8, which prevents the holder 4 being dislodged unintentionally from the pin 7 as a result of a blow, knock or some other impact.

When wishing to reduce the angle between the holder 4 and the rod 3, the slide 8 is displaced so that the support surface 15 will coact with the front end of the rod 3; see FIG. 5.

Figure 6:
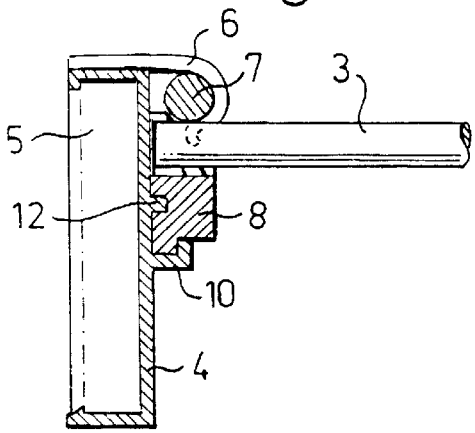

When wishing to position the holder 4 essentially vertically, the slide 8 is moved until its recess 16 is located opposite the end of the rod 3. It will then coact directly with the rear surface of the holder 4; see FIG. 6.

Figure 7:
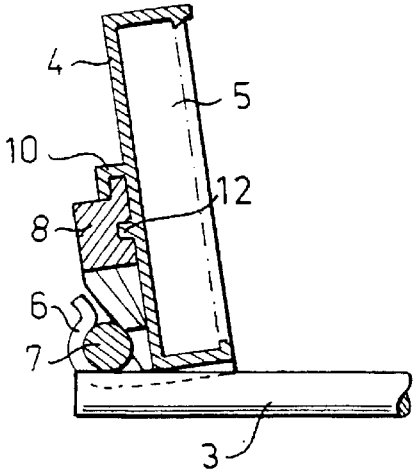

FIG. 7 shows how the holder 4 can be tipped up to allow the prong 1 to be replenished with further products or items. The position to which the holder is tipped is conveniently adapted so that the holder will drop down relatively freely. This prevents the holder from being raised as a result of a blow or some other impact and remaining in this raised position, since a slow and precisely balanced movement is required to raise the holder. In any other case, the holder will swing back to its original position gravitationally.

The slide 8 may, of course, be provided with any desired number of support surfaces that will enable the holder to be adjusted to a desired angle.

FIG. 2*a* shows an alternative embodiment of the slide 8. In this embodiment, the distinct support surfaces 14 and 15 have been replaced with a single continuous support surface 17 that slopes in a wedge-like manner in the longitudinal direction of the slide. The support surface 17 may, of course, have a varying slope in the vertical direction, so as to be well adapted to the end surface of the rod 3. Alternatively, the end surface of the rod 3 may be slightly bevelled.

A slide 8 of this construction enables the angle of the holder 4 to be adjusted smoothly and continuously, by displacing the slide so as to cause a desired part of the sloping support surface 17 to coact with the end of the rod 3.

Although the invention has been described above with reference to the illustrated exemplifying embodiments thereof, it will be understood that the structural design of these embodiments may be varied in several respects whilst retaining the desired function. For instance, the precise design of the slide 8 and its guide means can be varied as desired. Instead of coacting directly with the front end of the rod 3, the support surfaces may coact with selectively constructed support means mounted on the rod. The shape and number of the hook-like snap-over elements 6 can be varied. Another option is to use a single, broad generally U-shaped element.

What is claimed is:

1. A label holder for mounting in front of an outer end of a rod (3) which projects out from a product display stand and which includes means (7) for enabling the holder (4) to be pivotally mounted to the rod so as to allow the holder to be swung vertically, characterised in that a rear surface of the holder (4) includes support surfaces (14, 15) which are located at mutually different distances from the rear surface of the holder and which can be caused to coact selectively with an end surface of the rod (3) or with a means mounted on the rod to enable the holder (5) to be adjusted to different angles in relation to the rod.

2. A label holder according to claim 1, characterised in that said support surfaces (14, 15) are comprised of three juxtaposed, distinct support surfaces which enable the holder (4) to be set to any one of three different angular positions, by causing the end surface of the rod (3) or the rod-mounted means to coact with different support surfaces.

3. A label holder according to claim 1, characterised in that said support surfaces are formed by a continuous support surface (17) that slopes in the longitudinal direction of the holder (4) in a wedge-like manner, wherein the angle of the holder can be set continuously and smoothly by causing the end surface of the rod (3) or the rod-mounted means to coact with different parts of the sloping support surface (17).

4. A label holder according to claim 1, characterised in that said support surfaces (14, 15; 17) have different angles of slope in a vertical direction, to enable effective abutment between respective support surfaces and the end surface of the rod (3) or the rod-mounted means.

5. A label holder according to claim 1, characterised in that the support surfaces (14, 15; 17) are provided on a member (8) that can be displaced relative to the rear surface of the holder (4).

6. A label holder according to claim 5, characterised in that said member (8) has a form of a slide which is guided in a groove (10) on the rear surface of the holder.

7. A label holder according to claim 6, characterised in that the slide (8) includes a slot (11) for coaction with a guide strip (12) on the rear surface of the holder (4).

8. A label holder according to claim 6, characterised in that the slide (8) includes a through-passing recess (16) such that the rear surface of the holder (4) is able to form a support surface for the end surface of the rod (3) or for the rod-mounted means in one position of the slide.

9. A label holder according to claim 6, characterised in that it includes means (6) which when fitted on the rod (3) grips over a pin (7) attached transversely to the rod; and in that the slide (8) is adapted to prevent unintentional removal of the holder (4) from the pin (7).

10. A label holder according to claim 9, characterised in that said gripping means (6) is generally U-shaped and is constructed to define between itself and the rear surface of the holder (4) an opening through which the pin (7) can be passed; and in that said slide (8) blocks said opening at least partially when fitted.

* * * * *